United States Patent [19]

Nemoto

[11] 4,182,043

[45] Jan. 8, 1980

[54] DRAWING INSTRUMENT FOR AN ELLIPSE

[76] Inventor: Yoshio Nemoto, 354, 2-chome, Tenjun-cho, Kodaira, Tokyo, Japan

[21] Appl. No.: 925,856

[22] Filed: Jul. 18, 1978

[30] Foreign Application Priority Data

Jul. 18, 1977 [JP] Japan ..... 52-85839

[51] Int. Cl.[2] ..... B43L 11/04

[52] U.S. Cl. ..... 33/31; 33/30 R

[58] Field of Search ..... 33/30 R, 30 G, 31

[56] References Cited

U.S. PATENT DOCUMENTS

| | | | |
|---|---|---|---|
| 922,560 | 5/1909 | Brickey | 33/31 |
| 1,029,515 | 6/1912 | Schreiber | 33/31 |
| 2,926,423 | 3/1960 | Johnson | 33/30 G |

FOREIGN PATENT DOCUMENTS

| | | | |
|---|---|---|---|
| 150263 | 7/1937 | Austria | 33/30 R |
| 575976 | 5/1933 | Fed. Rep. of Germany | 33/31 |

*Primary Examiner*—John W. Shepperd

*Attorney, Agent, or Firm*—McGlew and Tuttle

[57] ABSTRACT

A drawing instrument for drawing an ellipse having two arms extending to left and right associated with operating mechanisms, so that when the arms are opened by a turning force of a first arm, a center moves along the straight line C, C′ at a right angle to a straight line B, B′ while maintaining two angles $\theta$ and $\theta'$, which are formed between the straight lines B, B′ extending between centers of the bed seats or supports and left and right arms about the center, equal to each other.

2 Claims, 9 Drawing Figures

DRAWING INSTRUMENT FOR AN ELLIPSE

BACKGROUND OF THE INVENTION

This invention relates to drawing instruments for drawing an ellipse which can accurately draw an ellipse as desired in a simple operation.

Despite rapidly increasing recent demand and interest in drafting machines or the like, particularly in a stereography, there is now not available a suitable draftsman's outfit for drafting an ellipse as a basic figure thereof. Known devices have limitations such that (a) one semi-ellipse is first drawn and thereafter the device is rotated 180° to draw the other semi-ellipse thus finishing a one complete ellipse, or (b) an extremely small ellipse or an ellipse close to a straight line is difficult to make with known devices, or (c) a drawing pen cannot be used, or (d) the operation is so complicated as to take skill, and so on.

Under actual circumstances, there was generally used, a template of synthetic resin formed with holes or openings, which could only make an ellipse of fixed angle and size as determined by the cut-out or opening.

SUMMARY OF THE INVENTION

The present invention has been achieved in an effort to obviate those disadvantages noted above with respect to prior known devices and to provide a drawing instrument for making an ellipse wherein left and right mechanisms are associated with each other by means of two arms extending from the top of a center, and having the center move along a straight line at a right angle to a straight line extending between the support or bed seats, and further provides a drawing instrument wherein left and right mechanisms are associated with each other by means of two arms extending from a center shaft, and the center properly moves along a straight line extending between centers of bed seat or supports and along a straight line intersecting at a right angle to the first-mentioned straight line.

BRIEF DESCRIPTION OF THE DRAWINGS

Embodiments of the present invention are shown in the accompanying drawings in which.

DETAILED DESCRIPTION OF THE INVENTION

Figure 1:
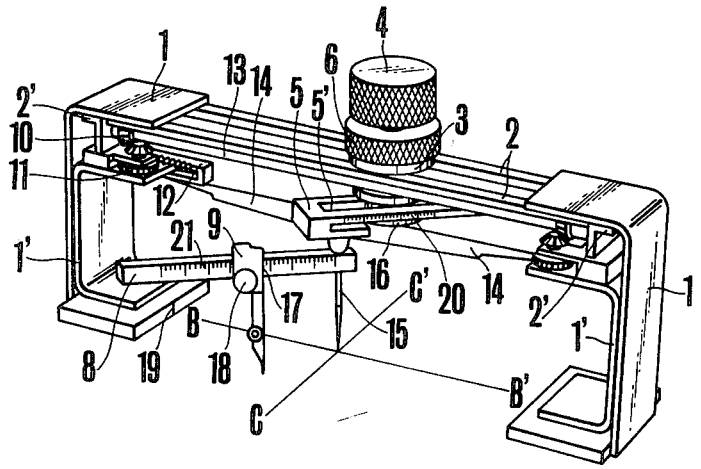
FIG. 1 is a perspective view of the device in accordance with the present invention.
Figure 2:
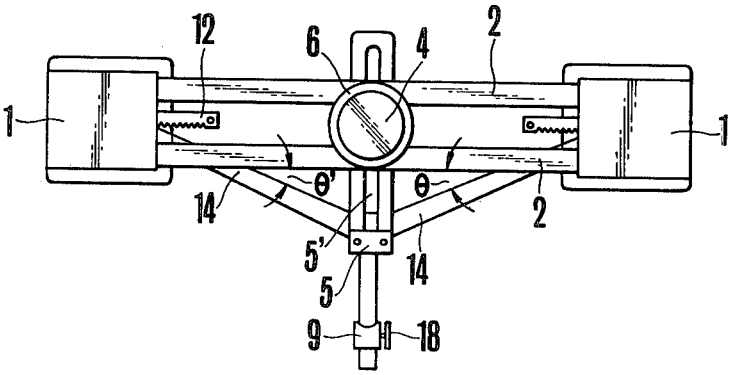
FIG. 2 is a plan view thereof.
Figure 3:
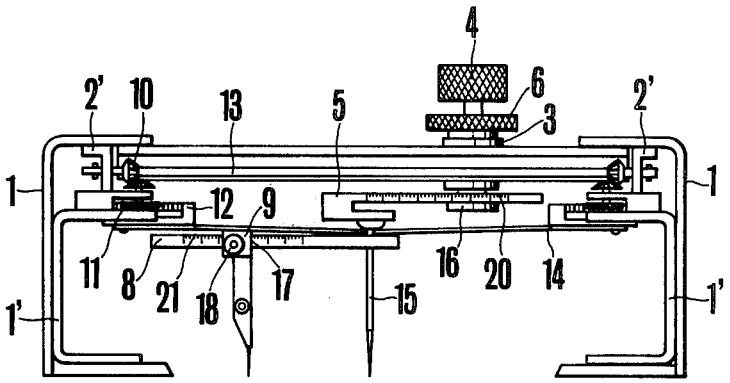
FIG. 3 is a front view thereof.
Figure 4:
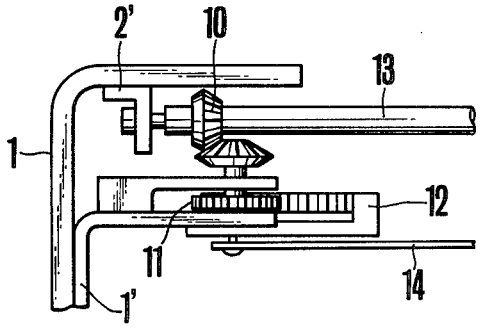
FIG. 4 is an enlarged view showing a part of the operating mechanism shown in FIG. 3.
Figure 5:
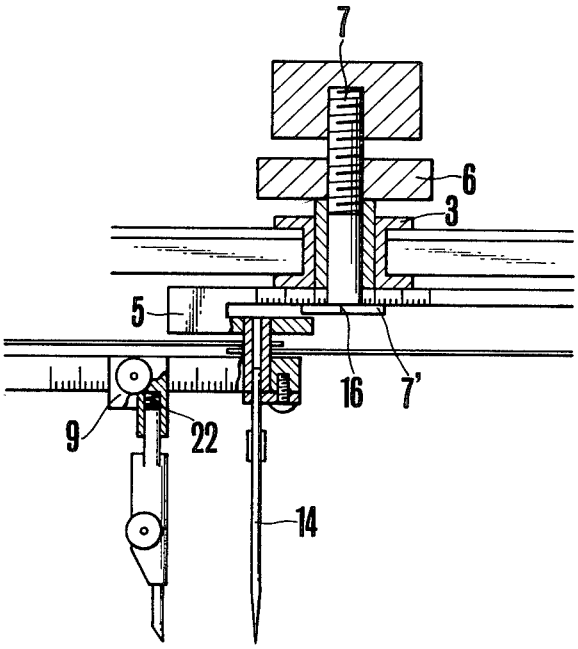
FIG. 5 is an enlarged view partly in section.
Figure 6:
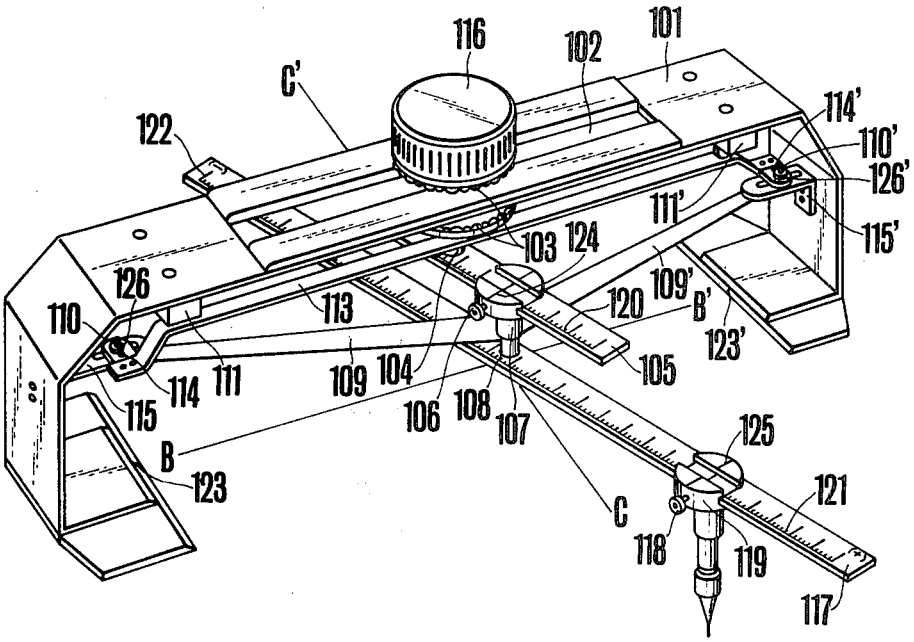
FIG. 6 is a perspective view showing a modified form of embodiment.
Figure 7:
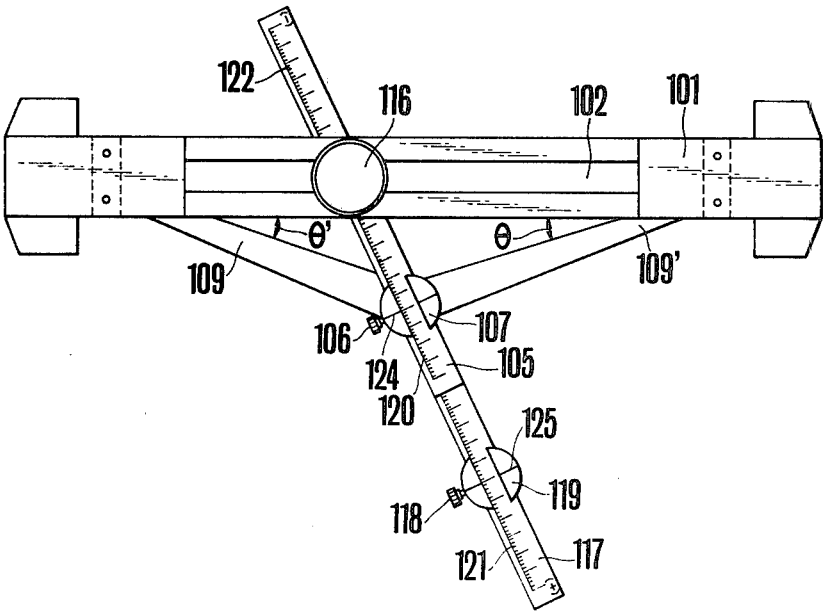
FIG. 7 is a plan view thereof.
Figure 8:
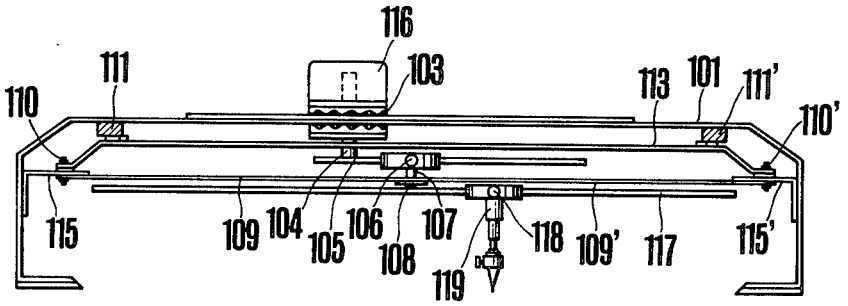
FIG. 8 is a front view thereof.
Figure 9:
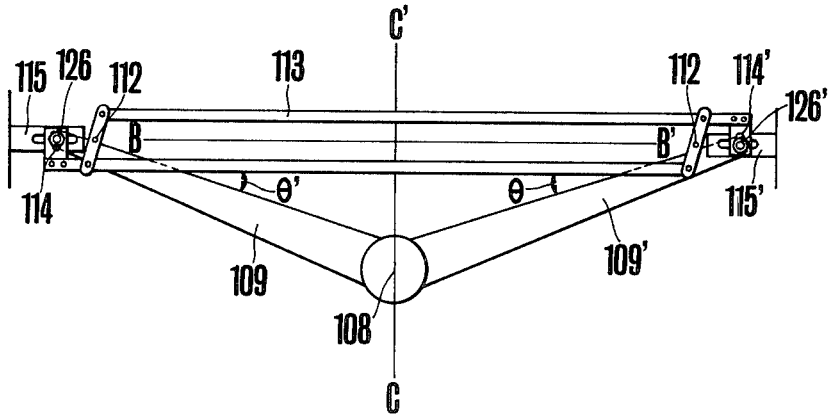
FIG. 9 is a plan view showing parallel crosses with the top portion of FIGS. 6, 7 and 8 removed.

In the following, the preferred embodiments of the present invention will be described with reference to the drawings.

A first embodiment will be first described with reference to FIGS. 1 to 5. Two opposedly disposed U-shaped seats or supports 1, 1 have two parallel bars or angles 2, 2 mounted thereon through mounting brackets or beds 2', 2', respectively to define a guideway. Between the angles or bars 2,2 forming the guideway is mounted a I-shaped metal member 3 whose center is in the form of a pipe so that the member may be laterally or transversely moved while being rotated by means of a knob 4. This metal member 3 comprises a center shaft 7 having a stopper 7' at the bottom in the center thereof and a nut 6 engaging threads in the center shaft 7. These mechanisms form, as a whole, an operating mechanism of a first arm as well as a retaining mechanism thereof, which will be described later.

A first arm 5 has a groove 5' formed therein so that the center shaft 7 may be fitted and moved, the first arm being locked by fitting the center shaft 7 in the groove 5', being held by the center shaft 7, and tightening the nut 6 by hand. The reference numeral 20 designates a scale.

Two arms 14, which are in the form of a flat plate, converge to a needle-like center 15, and mounted on the first arm 5 to be rotatable about the center 15, the arms having their ends slidably retained on an operating mechanism composed of a bevel gear 10, a spur gear 11, a rod-like gear 12 and a shaft 13, which are mounted through beds 1', 1' on the bed seats 1, 1.

A second arm 8 is provided with a slider 9 for mounting the lead of a pencil or a drawing pen for slight up and down movement by a spring 22. The arm 8 is mounted opposite the center 15 in the extended direction of the first arm 5. The reference numeral 21 designates a scale.

The reference numeral 16 designates a mark notched in the stopper 7' of the center shaft, and 17, an edge of the mounting slide. Referring to FIG. 1, 19 is a mark notched in the lower end of the bed seat.

Two arms 14 extending towards left and right from the top of the center as a whole are associated with each other and operatively supported on the left and right bed seats and the first and second arms 5, 8 are mounted in association with the operation of the center 15, whereby when the two arms 14 are opened through the operating mechanism by the turning force of the first arm 5 connected with the knob 4, two angles $\theta$ and $\theta'$ are formed between a straight line of B and B' connecting the centers 1 and 1 of left and right bed seat widths; and the left and right arms 14 and 14 about the center 15 are equal to each other, and the center 15 can move along a straight line of C and C' at a right angle to the straight line of B and B'.

In use of the drawing instrument in accordance with the aforementioned embodiment, the corner 17 of the lead of a pencil or pen mounting bed or slider 9 is first adjusted to the scale 21 notched in the side surface of the second arm 8 and the slider 9 tightened. With this, the radius of the minor axis of an ellipse to be predrawn is obtained.

Next, the round or circular nut 6 is loosened and the mark 16 is adjusted to the scale 20 notched in the side surface while sliding along the groove in the first arm 5. The round nut 6 is then turned and tightened. Addition or sum of the length of the scale 20 on the first arm 5 and the length of the scale 21 on the second arm 8 corresponds to the radius of the major axis of an ellipse to be drawn.

Now, an ellipse of suitable size may be drawn by positioning the instrument with the aid of the center 15 and the mark 19 indicative of the center of the bed seat widths notched in the lower end of the bed seat 1, and turning the knob 4.

Being constructed as described above, the drawing instrument of the present invention possesses various advantages such that the instrument is compact in construction and easy in operation, that if the scale is adjusted to the maximum, an ellipse greater than the full length of the instrument can be drawn, and that when the scale is adjusted close to the minimum, ellipses in the range of from a dot to a line may be accurately drawn.

Next, a further embodiment will be described with reference to FIGS. 6 to 9.

A horizontal portion on the top of a bed seat formed by inwardly bending opposite ends of an elongated plate 101 has an elongated groove 102 formed therein, and a grip shaft 104 is mounted to be moved smoothly and laterally by a bearing 103 or the like therebetween. A first arm 105 is secured to the lower portion of the grip shaft 104, the first arm 105 having a center shaft 107 which can be locked at a suitable position by tightening a screw 106. The center shaft 107 has a center 108 for the entire instrument in the central portion thereof. Arms 109 and 109' in the form of a flat plate extending from left and right hands are rotatably mounted on the center shaft 107, the arms 109 and 109' having short projections 110 and 110', respectively, at the extreme ends thereof.

The projections 110 and 110' are movably connected by stops 126 and 126' to shelves 115 and 115' provided with grooves 114 and 114' at the foremost ends of a mechanism 113 in the form of parallel crosses suspended by nails 112 and 112' through mounting beds 111 and 111' and elongated grooves in the central portion thereof, the shelves being extended from sides on left and right hands.

The mechanism 113 in the form of parallel crosses and the shelves 115 and 115' are provided so that when two arms 109 and 109' are opened by the turning force of the grip 116, two angles $\theta$ and $\theta'$ formed between the straight line of B and B' and left and right arms 109 and 109' about the center 8 are brought to be equal to each other, whereby the center 108 may always move properly along the straight line of B and B' and the straight line of C and C' at right angles thereto.

A second arm 117 is secured to the lower portion of the center shaft 107 to be equally distanced to left and right about the center shaft 107 and arranged parallel to the first arm 105.

Similarly to the center shaft 107, the second arm 117 has a pencil mounting bed 119 that may be secured to a suitable position by tightening a screw 118.

The reference numeral 120 designates a scale on the first arm 105. A scale on the second arm 117 is divided into a positive scale 121 and a negative scale 122 with the center 108 being zero.

It should be noted that marks 123 and 123' at the ends of the bed seats indicate the centers of the bed seat widths. The reference numeral 124 designates a mark adjusted to the scale on the first arm 105 to set the position of the center shaft 107, and numeral 125 is a mark adjusted to the scale on the second arm to set the position of the pencil mounting bed 119.

The device of the present invention may be used in the following.

(A) An ellipse extending in a direction of C, C'

First, the pencil mounting bed 119 is locked to a suitable position in a positive direction. Then, the radius of the minor axis of an ellipse to be drawn is obtained.

Next, the center shaft 107 is adjusted to the scale of the first arm 105 so that the center shaft 107 may be locked to a suitable position.

Addition of the length of the scale in the first arm 105 and the length of the scale in the second arm 118 corresponds to the radius of the major axis of the ellipse.

When the grip 116 is turned while moving the pencil mounting bed 119 close to the direction of scale-zero with the position of the center shaft 107 locked, the ellipse gradually comes close to a straight line and is finally formed into a straight line at the scale-zero.

(B) A circle

When the scale of the first arm 105 is adjusted to zero and locked and the grip 116 is turned, the length of the scale in the second arm 117 will correspond to the radius of a circle.

Also, even if the pencil mounting bed 119 is moved in a negative direction with the first arm 105 remained zero, the result will be the same.

(C) An ellipse extending in a direction of B, B'

First, the scale of the pencil mounting bed 119 is moved in a negative direction beyond the position of the center 119 and suitably locked.

The length obtained by deducting the length 120 of the positive scale of the first arm 105 from the length of the fixed negative scale 122 is the radius of the minor axis of the ellipse extending in a direction of B, B', and the length of the negative scale 122 of the second arm 117 serves to be the radius of the major axis of the ellipse without modification.

When the grip 116 is rotated while moving the pencil mounting bed 119 towards the center shaft 107, the ellipse gradually comes close to a straight line, and when the grip 104 and the pencil mounting bed 119 are superposed on the straight line, the ellipse finally assumes a straight line in a direction of B, B'.

(D) A dot from a small ellipse

As the scale of the center shaft 107 and the scale of the pencil mounting bed 119 move close to zero, the ellipse gradually becomes small, and when the center shaft 107 and the pencil mounting bed 119 are superposed at zero, the ellipse finally assumes a dot.

Being constructed as described above, the drawing instrument of the present invention possesses various advantages such that the instrument is extremely simple in operation, and that when the scale is adjusted to the maximum, an ellipse greater than the full length of the instrument can be drawn, and circles and ellipses in the range of from a dot to a line may be accurately drawn.

What is claimed is:

1. A drawing instrument for drawing an ellipse comprising; spaced-apart support members, means defining a guideway extending between said spaced-apart support members, a first arm member, a center connected to said first arm member, operating means slidably connected to said guideway means for movement therealong, means interconnecting said first arm member, said center and said operating means for adjustably positioning said center at a selected distance from said operating means, a second arm member defining an extension of said first arm member, a slider adjustably disposed along said second arm member, a marking stylus carried by said second slider, a pair of laterally extending arms having their adjacent ends pivoted about said center, a rack connected to each opposite end of said laterally extending arms, a spur gear rotatably mounted on each of said support members, each spur gear meshed with one of said racks, a first bevel gear connected to each of said spur gears, a second bevel gear meshed with each of said first bevel gears, and a common shaft connecting said second bevel gears, whereby said laterally extending arms defined with a straight line extending between said spaced-apart support members, two equal angles as said center traverses a straight line normal to said straight line extending between said spaced-apart support members as said operating means is moved.

2. A drawing instrument for drawing an ellipse comprising; spaced-apart support members, means defining a guideway extending between said spaced-apart support members, a first arm member, a center carried on said first arm member, operating means slidably connected to said guideway, means for movement therealong means interconnecting said first arm member, said center and said operating means for adjustably positioning said center at a selected distance from said operating means, a second arm member defining an extension of said first arm member, a slider adjustably disposed along said second arm member, a marking stylus carried by said slider, a pair of laterally extending arms having their adjacent ends pivoted about said center, and means for slidably connecting the respective other ends of said pair of arms to a corresponding support member, said means for slidably connecting the respective other ends of said pair of arms to a corresponding support member comprising, a shelf connected to each of said support members, each shelf having a slot therein, a projection connected to each of said other ends of said laterally extending pair of arms, each of said projections being receivable in a corresponding slot of each of said shelves, a parallel arm connected to each of said projections, and a cross link pivotally interconnected between one end of one of said parallel bars and an intermediate portion of the other of said parallel bars whereby said pair of laterally extending arms can be equally displaced as said center traverses a straight line normal to a straight line extending between said support members, whereby said laterally extending arms define with the straight line extending between said spaced-apart support members, two equal angles as said center traverses the straight line normal to said straight line extending between said support members as said operating means is moved.

* * * * *